US005522101A

United States Patent [19]

Yeh

[11] Patent Number: 5,522,101

[45] Date of Patent: Jun. 4, 1996

[54] BEDRAIL AND BEDPOST CONNECTION

[76] Inventor: Michael Yeh, 1821 Country Knoll Pl., Hacienda Heights, Calif. 91745

[21] Appl. No.: 325,610

[22] Filed: Oct. 19, 1994

[51] Int. Cl.[6] ..... A47C 19/00; F16B 7/18

[52] U.S. Cl. ..... 5/9.1; 5/282.1; 5/286; 403/334

[58] Field of Search ..... 5/9.1, 200.1, 201, 5/282.1, 286, 290, 296; 403/49, 263, 333, 334, 360, 362

[56] References Cited

U.S. PATENT DOCUMENTS

| | | | |
|---|---|---|---|
| 739,054 | 9/1903 | Bogert | 403/375 |
| 3,398,981 | 8/1968 | Vincens | 5/282.1 |

FOREIGN PATENT DOCUMENTS

| | | | |
|---|---|---|---|
| 1071513 | 9/1954 | France | 5/290 |
| 1138758 | 6/1957 | France | 5/290 |
| 2352194 | 12/1977 | France | 403/49 |
| 0557249 | 2/1957 | Italy | 5/282.1 |
| 0564327 | 6/1957 | Italy | 5/296 |

*Primary Examiner*—Steven N. Meyers
*Assistant Examiner*—Robert G. Santos
*Attorney, Agent, or Firm*—Charles H. Thomas

[57] ABSTRACT

A detachable coupling is provided to interconnect a horizontally disposed bed support rail to an upright bedpost. The ends of the bedrail are provided with vertically oriented, channel-shaped feet or pegs. Each such downward projection has a web extending transversely across the end of the bedrail and side walls secured to both sides of the bedrail. The foot depends from the bedrail end and the width of the side walls diminishes with distance from the bedrail, whereby the side walls are not quite rectangular, but are actually of trapezoidal shape. A vertically oriented, channel-shaped pocket is secured to the bedpost at each of the detachable coupling positions. The pocket has a web spaced outwardly from the bedpost and side walls secured to the bedpost. The pocket has a draft that conforms to the shape of the foot so as to snugly receive the foot therewithin. A transverse locking screw engages both the foot and the pocket so as to immobilize the foot within the pocket. A detachable coupling of this construction is far superior in structural rigidity as contrasted with conventional detachable bed frame joints.

10 Claims, 3 Drawing Sheets

BEDRAIL AND BEDPOST CONNECTION

BACKGROUND OF THE INVENTION

1. Field of the Invention

The present invention relates to an improved type of interconnection for releasably securing a bedrail to a bedpost. The invention has particular applicability to bunkbeds.

2. Description of the Prior Art

In virtually all bed construction the frame of a bed is formed by four bedposts, one at each corner of the bed, and at least a pair of longitudinally extending, elongated bedrails that extend the length of the bed and which are connected to the bedposts on either side of a bed. In some types of bed construction there are transverse bedrails that extend between the bedposts at the head and foot of the bed as well as the longitudinally extending bedrails on both sides of the bed.

Due to the large size of beds it is necessary for a bed frame to be constructed in such a manner that the bed can be disassembled for economy of packaging for sale, and also for movement and storage even after sale. To this end the bedposts and bedrails of a bed are constructed with releasable or detachable joints.

In one conventional type of bed construction the bedrails are provided with longitudinally extending metal plates that form tangs that extend beyond the ends of the bedrails. These tangs fit into vertical slots defined in the bedposts. One disadvantage with this type of interconnecting joint is the lack of lateral stability. Because the tangs are formed of relatively thin metal plates, the rails can move laterally relative to the bedposts to a certain extent. That is, the bed is prone to "racking", which means that with only relatively modest force the frame formed by the intersecting bedposts and bedrails can be twisted from the ideal orthogonal, rectangular configuration to the configuration of a parallelogram.

Furthermore, this type of bedjoint interconnection does not lend itself to use in beds formed of metal tube stock since the narrow plates are somewhat difficult to align with the vertical slots in the bedposts. Several attempts must sometimes be made to insert the tangs into the bedpost slots. With each missed attempt there is often a scarring or damage to the finish of the bedpost. Such damage is particularly visible in the case of an upper bed of a bunkbed.

Another type of prior releasable interconnection assembly that has been utilized as a detachable joint in bed frame construction is to provide the rail of a bed with a tapered fin that depends from the underside of a bedrail. The fin fits into a generally V-shaped bracket that is secured to the upright bedpost. In the case of a metal bed frame the bedrail is typically formed of tubular steel stock having a rectangular cross section. The depending fin is welded to the underside of the bedrail at the end thereof. However, due to the forces which are often exerted on a bed, particularly a bunkbed, it has been discovered that the welds holding the depending fin to the bottom of the rail sometimes break. This can lead to collapse or partial collapse of the bed.

An improvement to this design was then created. Specifically, instead of constructing the fin as a plate that depended only from the underside of the bedrail, a slot is cut in the underside of the bedrail at the end thereof and a fin of greater length is employed so as to fit into the slot. This longer fin not only depends beneath the underside of the bedrail, but also extends up through the hollow tubular structure of the bedrail into abutment against the top of the bedrail. The fin is then welded not only to the bottom of the bedrail where the fin passes downwardly through the slot, but also at the upper extremity of the fin that resides in abutment against the underside of the top of the bedrail. While this does provide some improved stability, it still did not achieve the structural integrity desired for the bed. Furthermore, this design does not significantly solve the problem of racking of the bed.

SUMMARY OF THE INVENTION

According to the invention a new and vastly improved detachable coupling between a horizontally disposed bed support rail having sides and an end and an upright bedpost has been devised. This coupling is preferably comprised of a vertically oriented, channel-shaped foot, peg, or projection having a web extending transversely across the end of the bedrail and side walls secured to both sides of the bedrail. The foot depends from the bedrail end and the width of the side walls of the foot diminishes with distance from the bedrail.

A vertically oriented, channel-shaped pocket is secured to the bedpost and has a web spaced outwardly from the bedpost and side walls secured to the bedpost. The pocket has a draft that conforms to the shape of the foot to snugly receive the foot therewithin. A releasable locking member is provided that engages both the foot and the pocket so as to immobilize the foot within the pocket. This locking member may take the form of a metal screw that passes through the web or side wall of the pocket and into an opening in the structure of the foot.

A primary object of the present invention is to provide a detachable coupling or joint for releasably securing a bedrail to a bedpost of greatly improved structural integrity. Because the depending foot extends across the entire width of the bedrail, the web of the foot facing the bedpost can reside in intimate contact therewith over a considerably greater lateral distance than is the case with prior designs. If the bedpost is curved, as in the case of a cylindrical, tubular bedpost of the type often utilized with bunkbeds, the web of the foot can be curved in a corresponding, concave manner to more or less match the lateral curvature of the bedpost. The web thus resides in contact with the structure of the bedpost at laterally spaced locations across the width of the web. This greatly enhances the rigidity of the joint and markedly decreases the tendency of the bed to rack.

A further object of the invention is to provide a releasable connection assembly between a bedrail and bedpost that can be engaged more easily than conventional joints. A detachable coupling according to the invention employs a relatively wide foot or projection that has a slight taper in a longitudinal direction. That is, the walls of the foot or projection taper from a maximum width in the longitudinal direction at the junction of the foot with the bedrail to a minimum width proceeding downwardly toward the depending, distal end of the foot. This relatively narrow end of the foot may be easily guided into the relatively large, upwardly facing mouth of the pocket. As the bedrail is lowered into position, the foot depending therefrom nests snugly into the pocket, and the tapered edges of the side walls of the foot reside in contact throughout with the inside wall of the web of the channel-shaped member forming the pocket. At the same time, as previously noted, the web of the foot resides in contact across its width with the surface of the bedpost. This system provides a detachable coupling that is more easily engaged than conventional joints, but which is of far greater structural stability once engaged.

In one broad aspect the present invention may be considered to be a detachable joint for releasably securing a horizontally disposed bedrail having an end and laterally spaced sides to an upright bedpost. The detachable joint is comprised of a vertically oriented projection depending downwardly from the end of the bedrail and having a transverse web disposed across the bedrail end and side walls secured to the bedrail sides. The side walls are tapered toward the web with a downward draft. The joint also includes a vertically oriented, upwardly opening socket or pocket secured to the bedpost and having a draft conforming to that of the side walls and configured to snugly seat the projection therewithin. Preferably, a releasable locking means engages the socket with the projection when the projection is seated in the socket to prevent withdrawal of the projection from the socket unless released. The releasable locking means may be formed of a metal screw that extends through one side wall of the socket and is engaged in the side wall of the projection residing within the socket.

Preferably the projection has a channel-shaped cross section. When the bedpost is of a curved, tubular cross section, the web of the projection has an outwardly facing, concavely curved surface that follows the curvature of the bedpost so as to reside in contact therewith at locations spaced across the width of the web of the projection when the projection is seated in the socket.

In another broad aspect the invention may be considered to be a releasable connection assembly for joining a horizontally disposed bedrail having an end and laterally spaced sides to an upright bedpost comprising: a peg depending downwardly from the bedrail and having a web disposed across the bedrail end and side walls joined to the web and secured to the bedrail sides. The side walls of the peg are tapered from a maximum width at the bedrail sides toward the downwardly projecting tip of the peg. The releasable connection assembly also includes an upwardly opening, vertically oriented pocket secured to the bedpost and having a transverse back wall oriented at an incline relative to the bedpost to match the taper of the side walls of the peg. The pocket has side walls joined to the back wall and secured to the bedpost and spaced laterally from each other so as to receive the side walls of the peg snugly therebetween. A releasable locking member preferably holds the peg in the pocket.

The invention may be described with greater clarity and particularity with reference to the accompanying drawings.

DESCRIPTION OF THE EMBODIMENT

Figure 2:
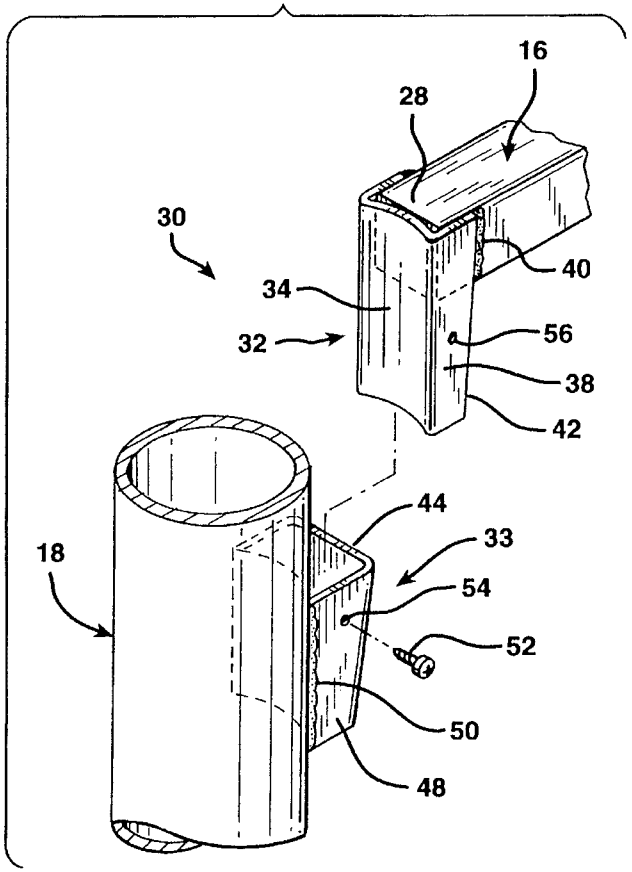
FIG. 2 is an exploded perspective detail illustrating a single one of the detachable couplings in the bed of FIG. 1.
Figure 1:
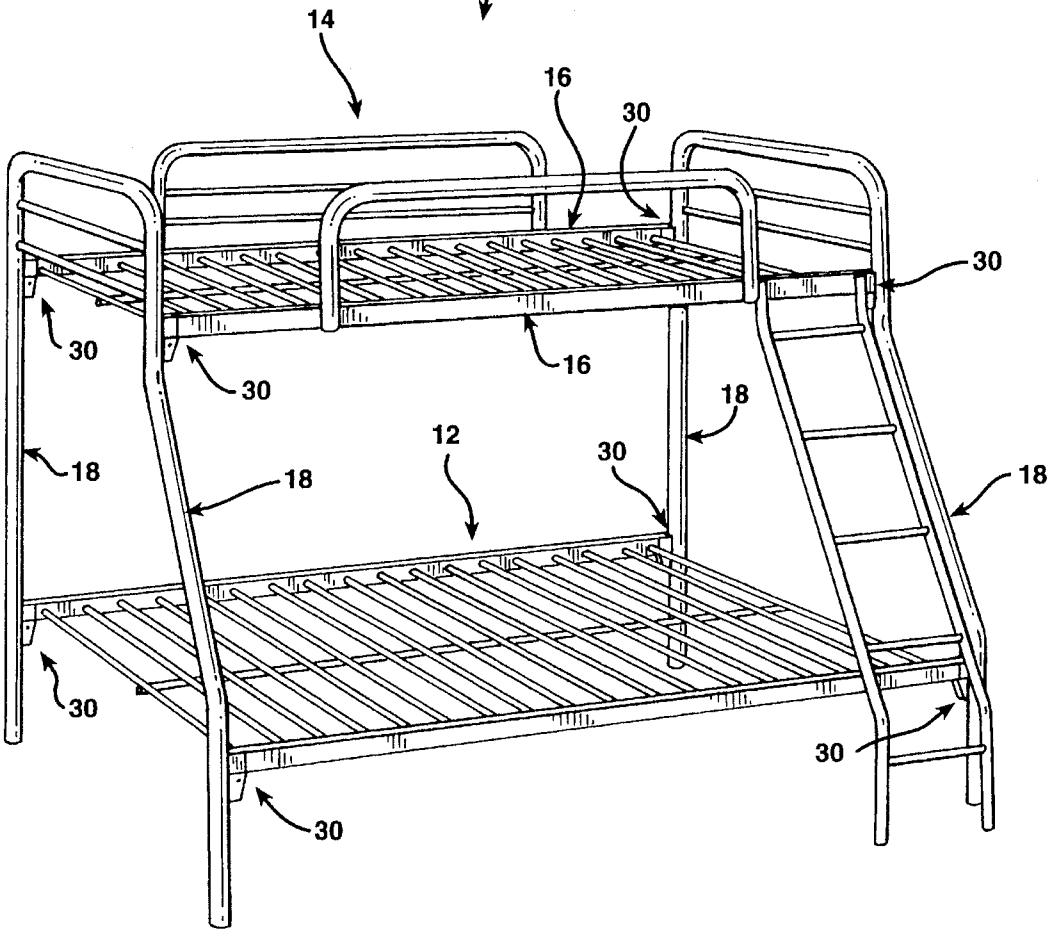
FIG. 1 is a perspective view illustrating a bunkbed frame employing the detachable joints or couplings according to the invention.
Figure 3:
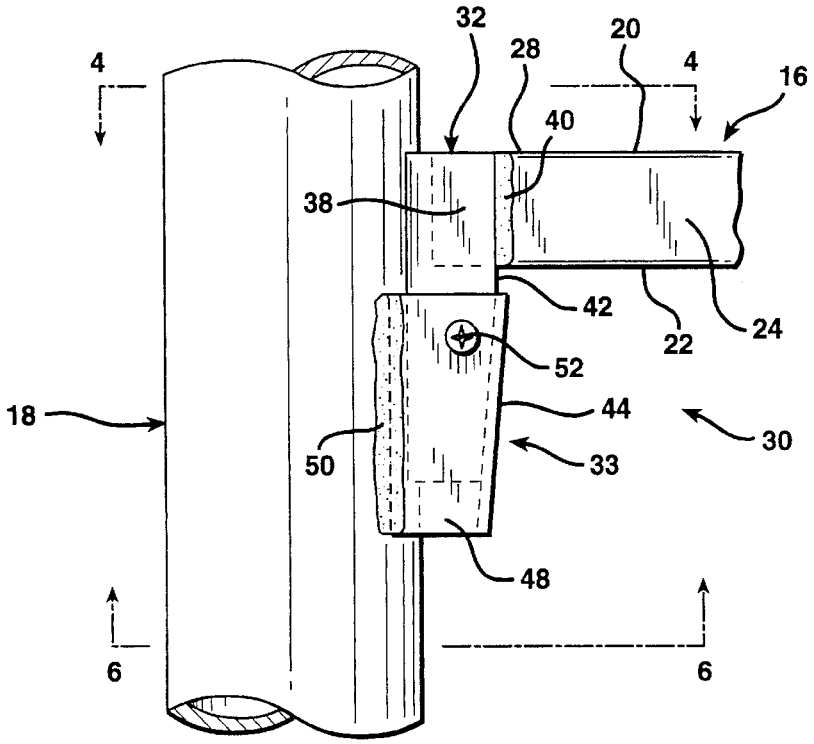
FIG. 3 is a side elevational view showing the detachable coupling of FIG. 2 in the engaged position.
Figure 4:
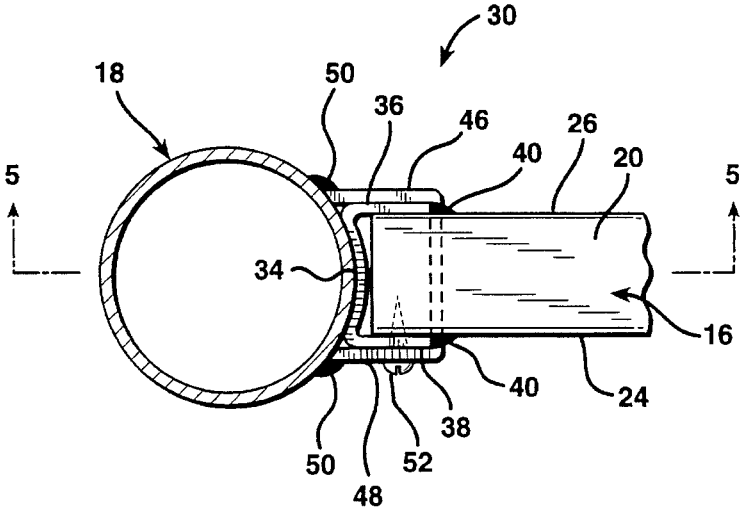
FIG. 4 is a plan view taken along the lines 4—4 of FIG. 3.
Figure 5:
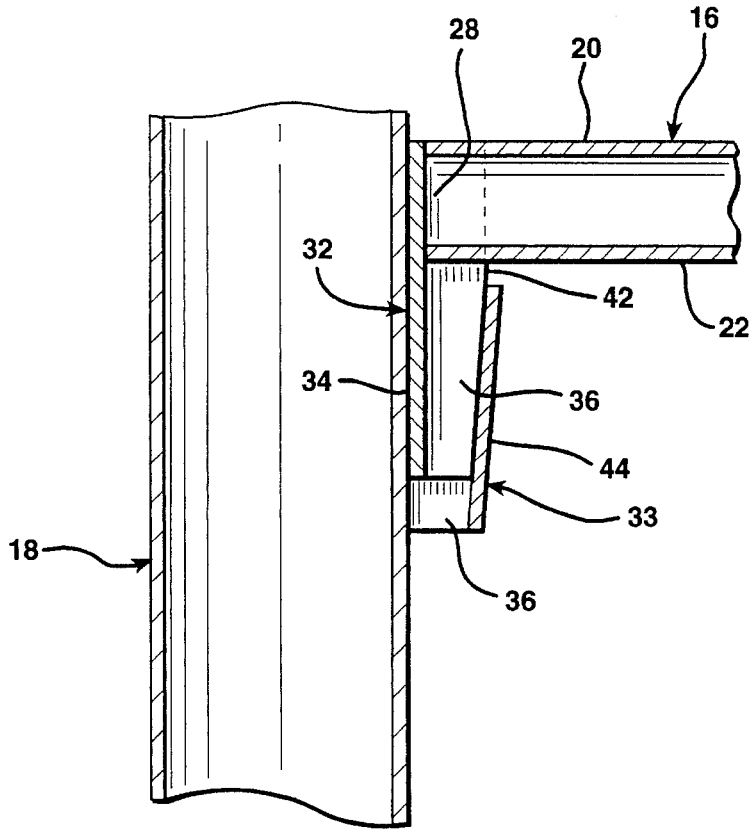
FIG. 5 is a sectional elevational view taken along the lines 5—5 of FIG. 4.

FIG. 1 illustrates a bunkbed set 10 having a lower bed frame 12 and an upper bed frame 14. Both of the bed frames 12 and 14 include a pair of longitudinally extending bedrails 16 that extend the lengths of the bed frames 12 and 14 which are releasably attached to bedpost 18 at both the head and foot of the bed frames 12 and 14. As shown in FIGS. 2, 3, and 4 the bedposts 18 are formed from a length of hollow tubular, cylindrical steel about two inches in outer diameter, bent into a generally inverted U-shaped configuration. The ends of the tubular steel stock form the upright bedposts 18 at both the head and the foot of the bunkbed assembly 10. As shown in FIGS. 2 and 5, the bedrails 16 are each formed of hollow, rectangular, tubular steel members. As shown in FIGS. 3–6 each of the bedrails 16 has a transverse, horizontally disposed top wall 20, an opposite, horizontally disposed bottom wall 22, both about one inch in width, and vertically disposed left and right side walls 24 and 26, each about two inches in width. Each of the bedrails 16 has opposing open ends 28.

The bedrails 16 are releasably connected to the bedpost 18 by releasable or detachable connection assemblies 30. All of the releasable connection assemblies 30 are identical in construction. A single one of the releasable connection assemblies 30 is depicted in detail in FIGS. 2–6.

Each releasable connection assembly 30 serves as a detachable joint for releasably securing one of the horizontally disposed bedrails 16 to one of the upright bedposts 18. Each connection assembly 30 includes a vertically oriented channel-shaped projection 32 that depends downwardly from a bedrail 16 in the form of a peg or foot. Each projection 32 is formed from a bent steel plate and has a channel-shaped cross sectional configuration. Each projection 32 is formed with a transverse web 34 disposed across the otherwise open bedrail end 28. At its lateral edges the steel plate forming the projection 32 is bent around to form a pair of mutually parallel side walls 36 and 38. The side walls 36 and 38 are secured by linear welds 40 to the vertically oriented sides 24 and 26 of the bedrail 16. Each of the sides 36 and 38 has a slightly trapezoidal configuration in that the longitudinally interior edge 42 thereof is tapered toward the web 34 with a downward draft of between about two and about ten degrees.

The outwardly facing exposed surface of the web 34 has a convex shape formed with a radius of curvature about the same, and no greater than, the radius of curvature of the outer, cylindrical surface of the bedpost 18. By forming the web 34 in this manner the outer concave surface thereof is able to reside either in intimate contact with the outer, convex, cylindrical surface of the bedpost 18 or at least in contact therewith at locations spaced across the width of the web 34 when the projection 32 is received and seated within the pocket 33.

Each pocket 33 is likewise constructed from a steel plate bent into a channel-shaped structure that forms a transverse back wall or web 44 and is oriented at an incline relative to the bedpost 18 so as to have a draft conforming to the incline of the side wall edges 42 of the projection side walls 36 and 38 relative to alignment of the projection 32. The pocket 33 also has side walls 46 and 48 that emanate from the back wall or web 44. The side walls 46 and 48 are secured to the bedpost 18 by welds 50. The pocket side walls 46 and 48 thereby likewise have a slightly trapezoidal configuration such that the longitudinally outer extremities thereof meet the inclined back wall 44 and are inclined at an angle of between about two degrees and about ten degrees relative to the alignment of the bedpost 18.

As best shown in FIGS. 3 and 5, the projections 32 seat snugly within the pockets 33. The longitudinally interior edges 42 of the projection side walls 36 and 38 establish continuous, linear contact with the inwardly facing surface of the web or back wall 44, as illustrated in FIG. 5, while the longitudinally, outwardly facing surface of the projection web 34 resides in contact with the convex outer surface of the cylindrical bedpost 18 at laterally separated points of contact, or even intimately throughout as depicted.

Figure 6:
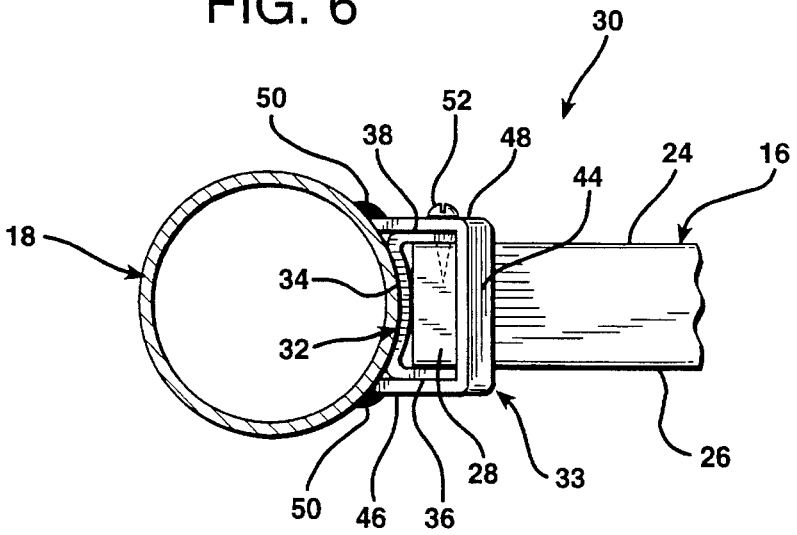
FIG. 6 is a bottom plan view taken along the lines 6—6 of FIG. 3.

As is evident, especially from FIGS. 4 and 6, once the projections 32 are seated within the pockets 33, the detachable joints 30 have considerable lateral stability. The web 34 of the foot or projection 32 is at least one-quarter of an inch, and preferably is about one inch in width. This width is sufficient to prevent the siderail 16 from twisting about a vertical axis since there is virtually no play permitted between the projection 32 and the pocket 33 when the projection 32 is fully seated.

To maintain the projection or foot 32 in a condition fully seated within the pocket 33, the detachable joint 30 is provided with a releasable locking mechanism that holds the projection 32 within the pocket 33 and prohibits any relative vertical movement therebetween. The machine screw 52 serves as a simple but effective means for performing this function. The side wall 48 of the pocket 33 is drilled and tapped to form an opening of a diameter that permits threaded engagement of the shank of the machine screw 52 therewith. A corresponding bore 56 is formed in the side wall 38 of the projection 32. The bore 56 may either be tapped or not.

The position of the bore 56 is determined by first creating the aperture 54 and then fully seating the projection 32 within the pocket 33. The position of the bore 56 can then be marked on the side wall 38 and the projection 32 removed. The bore 56 can then be drilled and also tapped if desired. This ensures that the bores 54 and 56 are coaxially aligned when the projection 32 is fully seated in the pocket 33. Naturally, on a production basis the positions of the bores 54 and 56 are predetermined and can be drilled prior to any assembly of the elements of the detachable joints 30.

The locking screw 52 can be readily removed to permit disassembly of the bed 10. Once the locking screws 52 are removed, the rails 16 can be lifted vertically relative to the bedposts 18 to thereby lift the projections 32 out of the pockets 33. The bed 10 can then be readily disassembled for transportation or storage and reassembled in a manner of minutes when appropriate.

Undoubtedly, numerous variations and modifications of the invention will become readily apparent to those familiar with the construction of bed frames. For example, the projections or feet 32 need not necessarily be configured as channel-shaped members, but could be tubular or even solid. Also, the bed frame members 16 need not necessarily be formed of rectangular, tubular stock, but can be solid or of a channel-shaped configuration. Different shapes and forms of construction can be utilized to fabricate all of the members illustrated in the drawings. Accordingly, the scope of the invention should not be construed as limited to the specific embodiment depicted and described.

I claim:

1. In a bunkbed including a detachable joint for releasably securing a horizontally disposed bedrail having an end and laterally spaced sides to an upright bedpost the improvement comprising:

a vertically oriented projection rigidly joined to and depending downwardly from said end of said bedrail and having a transverse web disposed to extend across the entire width of said bedrail end and projection side walls secured to said bedrail sides and tapered toward said web with a downward draft, a vertically oriented, upwardly opening socket rigidly secured directly to said bedpost and having socket sides with a draft conforming to that of said side walls of said projection and a transverse socket web rigidly joined to said socket sides throughout their lengths and spaced from said bedpost and inclined relative thereto so that said socket forms a complete lateral enclosure and is configured to snugly seat said projection therewithin and wherein a horizontally oriented, internally tapped opening is defined through one of said socket sides, and a releasable locking screw that passes through and is engaged directly in the structure of said socket in said internally tapped opening in said one of said socket sides and is also engaged directly with said projection.

2. A bunkbed according to claim 1 in which said projection has a channel-shaped cross section.

3. A bunkbed according to claim 1 in which said bedpost has a curved tubular cross section and said web of said projection has an outwardly facing concavely curved surface that follows the curvature of said bedpost so as to reside in contact therewith at locations spaced across the width of said web of said projection when said projection is seated in said socket.

4. In a bunkbed employing a releasable connection assembly for joining a horizontally disposed bedrail having an end and laterally spaced sides to an upright bedpost the improvement comprising:

a peg rigidly joined to and depending downwardly from said bedrail and having a web disposed to extend entirely across the width of said bedrail end and peg side walls joined to said web and secured to said bedrail sides and wherein said peg side walls are tapered from a maximum width at said bedrail sides, an upwardly opening, vertically oriented pocket rigidly secured directly to said bedpost and having a transverse back wall spaced from and oriented at an incline relative to said bedpost to match the taper of said side walls of said peg and spanning the distance of said peg and having sides emanating from said back wall and secured to said bedpost and spaced laterally from each other and joined to said back wall throughout its entire length so as to receive said side walls of said peg snugly therebetween and in facing relationship relative thereto within a laterally enclosed space, and wherein an internally tapped opening is defined through one of said pocket sides and an aligned opening is defined through a facing side wall of said peg, and a releasable locking screw that is engaged in said tapped opening in said one of said pocket sides and wherein said screw is directed into said aligned opening of said facing side wall of said peg, whereby said screw is engageable directly with both said pocket and said peg.

5. A bunkbed according to claim 4 wherein both said peg and said pocket are formed of channel shaped members.

6. A bunkbed according to claim 5 wherein said bedrail, said bedpost, said peg, and said pocket are all formed of metal, and said peg is welded to said bedrail and said pocket is welded to said bedpost.

7. In a bunkbed having a detachable coupling between a horizontally disposed bed support rail having sides and an end and an upright bedpost the improvement comprising:

a vertically oriented, channel-shaped foot rigidly joined to said bed support rail and having a web extending transversely entirely across said end of said bedrail and side walls secured to both of said sides of said bedrail, wherein said foot depends from said bedrail end and wherein the width of said side walls diminishes with distance from said bedrail, a vertically oriented, channel-shaped pocket rigidly secured directly to said bedpost and having a socket web spaced outwardly from said bedpost and entirely spanning the width of said foot and having side walls rigidly secured to said bedpost and rigidly joined to said socket web throughout the length thereof to thereby form a complete lateral enclosure with said bedpost, wherein said pocket has a draft that conforms to the shape of said foot to snugly receive said foot therewithin with said side walls of said foot residing in facing relationship with said side walls of said pocket, and wherein an internally tapped opening is defined through one of said pocket side walls and a corresponding aligned opening is defined through a facing one of said side walls of said foot, and a screw threadably engaged in said internally tapped opening in said pocket side wall wherein said screw projects into said aligned opening in said facing one of said side walls of said foot so as to immobilize said foot within said pocket.

8. A bunkbed according to claim 7 wherein said bedpost has an outer convex surface and said web of said foot has an outer concave surface so as to reside in contact with said bedpost at laterally separated points of contact when said foot is received within said pocket.

9. A bunkbed according to claim 7 wherein said bedrail, said bedpost, said foot, and said pocket are all formed of metal and said foot is welded to said bedrail and said pocket is welded to said bedpost.

10. A bunkbed according to claim 9 wherein said bedrail is formed of tubular, rectangular steel stock and has mutually parallel sides, and said side walls of said foot embrace said sides of said bedrail.

* * * * *